US006352563B1

(12) United States Patent
Kusaki et al.

(10) Patent No.: US 6,352,563 B1
(45) **Date of Patent: *Mar. 5, 2002**

(54) PRINTED CLOTH AND METHOD OF MANUFACTURING THE SAME

(75) Inventors: Kazuo Kusaki, Shiga; Toshikazu Fuse, Nagahama; Tohru Morita, Kawanishi; Toshihiko Ishihara, Sanda; Kazuyoshi Morimoto; Kazuo Iwata, both of Nagahama; Michiyo Nishimura, Shiga, all of (JP)

(73) Assignee: Kanebo, Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/510,179

(22) Filed: Feb. 22, 2000

Related U.S. Application Data

(63) Continuation of application No. 08/868,479, filed on Jun. 3, 1997, now Pat. No. 6,051,036, which is a continuation of application No. 08/211,255, filed as application No. PCT/JP93/00601 on Apr. 30, 1993, now abandoned.

(30) Foreign Application Priority Data

| | | |
|---|---|---|
| Jul. 27, 1992 | (JP) | 04-220755 |
| Aug. 11, 1992 | (JP) | 04-236489 |
| Aug. 12, 1992 | (JP) | 04-237795 |
| Oct. 6, 1992 | (JP) | 04-293816 |

(51) Int. Cl.[7] ..... D06P 5/15; D06P 5/30

(52) U.S. Cl. ..... 8/494; 8/495; 8/499; 8/552; 8/561; 8/563; 8/580; 8/581; 8/585; 8/638

(58) Field of Search ..... 8/445, 478, 480, 8/490, 494, 495, 499, 543, 557, 558, 562, 609, 638, 552, 559, 561, 563, 580, 581, 585, 930; 106/22 R, 20 D; 346/78; 347/6, 74, 100, 103, 106, 107, 195; 428/195

(56) References Cited

U.S. PATENT DOCUMENTS 5,494,733 A * 2/1996 Koike et al. ..... 428/224
5,645,631 A * 7/1997 Koike et al. ..... 347/106
6,033,066 A * 3/2000 Koike et al. ..... 347/101

OTHER PUBLICATIONS

English language translation of JP 61–231,279, Toray, pp. 1–9, Oct. 1986.*

English language translation of JP 2–298,399, Kanebo, pp. 1–14, Jun. 1992.*

Derwent English language Abstract of 61–055,277, Toray Ind., Oct. 1986.*

* cited by examiner

*Primary Examiner*—Margaret Einsmann
(74) *Attorney, Agent, or Firm*—Morgan & Finnegan, L.L.P.

(57) ABSTRACT

A printed cloth in which a dye is deposited in dots on the cloth to form a desired printed pattern. Said dot deposition is formed in a length of 0.05 to 0.3 mm to the longitudinal direction of the fiber in single fiber unit of the yarn constituting said cloth. A fine printed pattern is deposited clearly in good reproducibility. The printed pattern can be formed by using the dyes of the three primary colors or of the three primary colors and black color. It is preferred that Dyes I , II and III having a perceived chromaticity index (a) and (b) defined in the color range [CIE 1976 (L, a, b) space] on the cloth within the following range are used as said dyes of three primary colors and DyeIV is used as said black dye.

| | | | | | |
|---|---|---|---|---|---|
| I | Yellow: | (a) | −20~0 | (b) | 50~90 |
| II | Red: | (a) | 50~70 | (b) | 0~20 |
| III | Blue: | (a) | −50~−1 | (b) | −50~−20 |
| IV | Black: | (a) | −6~6 | (b) | −6~6 |

Such a printed cloth can be prepared by a procedure in which a printing ink is deposited in dots on the surface of a cloth by using a dye spraying device having a nozzle of 80 dots/mm or more and controlled based on the image signal.

6 Claims, No Drawings

PRINTED CLOTH AND METHOD OF MANUFACTURING THE SAME

This is a continuation of application Ser. No. 08/868,479 filed Jun. 3, 1997, now U.S. Pat. No. 6,051,036, which is a continuation of application Ser. No. 08/211,255 filed Mar. 24, 1994, now abandoned, which is a 371 of PCT/JP93/00601, filed Apr. 30, 1993.

TECHNICAL FIELD

The present invention relates to a printed cloth on which dyes are deposited in dots and a method for the preparation thereof.

TECHNICAL BACKGROUND

Conventionally, screen printing process and roller printing process have been applied as the method for printing cloths. However, these processes require screens and chased rolls according to the desired printing patterns. Therefore, they showed difficulties in both workability and economics when each small lots of many grades was required to be printed.

Thus, the ink jet printing process has been investigated and various patent applications have been submitted including Japanese Laid-Open Patent Publication No. 6347 of 1986, No.300377 of 1990 and No.45774 of 1991.

Japanese Laid-Open Patent Publication No.6347 of 1986 describes that a fine pattern of deep color can be attained by performing dot dyeing so that a) the average of the major axis and the minor axis of the dot is 100 to 500 $\mu$m, b) the dot density is not higher than 16 dots/mm and c) the dots penetrate through the front surface to the back surface and part of the color points can be seen on the back surface of the cloth. However, by such a dyeing method, no deeper color can be attained than that attained by screen printing and no fine line of 0.3 mm or less can be attained as a printed pattern. It was also difficult to give an exact stripe pattern and a natural gradation pattern.

The object of the present invention is to provide a printed cloth in which fine line of 0.3 mm or less, an exact stripe pattern, a natural gradation pattern or the like is clearly dyed in a deep color, which could not be attained by conventional methods.

DISCLOSURE OF THE INVENTION

The product of the present invention is one in which a desired printed pattern is formed on a cloth by dyeing in dot a dye on it by a special ink jet process. The present invention is also characterized in that the dot dyeing is formed in a length of 0.05 to 0.3 mm to the longitudinal direction per single fiber unit constituting the cloth.

Thus, in the present invention, the dyeing unit of the dot dyeing formed is a very small line of 0.3 mm or less along the fiber to the longitudinal direction of the fiber with a thickness of the single fiber (about 0.01 to 0.1 mm). Therefore, each yarns constituting the cloth can be dyed in different colors as if they consist of different grandrelle yarns to obtain a product having fine lines, an exact stripe pattern and the like, which could not be accomplished up to now.

The printed pattern prepared by the present invention is basically formed by dot dyeing a very small line along the fiber of 0.3 mm or less to the longitudinal direction of the fiber with a thickness of the single fiber (about 0.01 to 0.1 mm). Alternatively, the dot dyeing is accomplished by each adjacent or plurality of adjacent fibers to a same color and the part in which one dot dyeing is made over the adjacent fibers such that half thicknesses of the adjacent fibers are dyed.

The product of the present invention can be prepared by a printing process according to ink jet method as described in Japanese Patent Application No.278112 of 1990, No.298399 of 1990 and No.88545 of 1991. However, it is preferred to be formed by using dyes of the three primary colors or the three primary colors and a black color as the dyes. By using them, the present invention can achieve not less than 125 combined colors per unit pattern.

Three dyes including yellow, red (magenta) and blue (cyan) are used as the dyes of the three primary colors. It is preferred to use dyes (I to IV) having a perceived chromaticity index defined in CIE 1976 (L, a, b) space on the cloth of at least in the following range respectively as these dyes and the black dye:

| | | | | | |
|---|---|---|---|---|---|
| I | Yellow | (a) | −20~0 | (b) | 50~90 |
| II | Red | (a) | 50~70 | (b) | 0~20 |
| III | Blue | (a) | −50~−10 | (b) | −50~−20 |
| IV | Black | (a) | −6~6 | (b) | −6~6 |

These dyes may also be used as a combination of at least two of each colors. The dyes of the following range can be also used in combination:

| | | | | | |
|---|---|---|---|---|---|
| V | Yellow | (a) | 0~20 | (b) | 50~90 |
| VI | Yellow (orange) | (a) | 20~70 | (b) | 40~90 |
| VII | Red | (a) | 50~70 | (b) | −20~0 |
| VIII | Blue | (a) | −10~20 | (b) | −50~−20 |
| IX | Violet | (a) | 20~70 | (b) | −50~−20 |
| X | Green | (a) | −70~−20 | (b) | 50~90 |
| XI | Navy blue | (a) | −10~10 | (b) | −20~−5 |

It has been found that a printed cloth of wide color range and of high clearness can be prepared particularly when seven dyes having a perceived chromaticity index defined in CIE 1976 (L, a, b) space on the cloth of at least the following range respectively are used in combination:

| | | | | | |
|---|---|---|---|---|---|
| 1. Yellow 1 | (a) | −20~0 | (b) | 50~90 |
| 2. Yellow 2 | (a) | 0~20 | (b) | 50~90 |
| or | (a) | 40~60 | (b) | 40~80 |
| 3. Red 1 | (a) | 50~70 | (b) | 0~20 |
| 4. Red 2 | (a) | 50~70 | (b) | −20~0 |
| 5. Blue 1 | (a) | −40~−10 | (b) | −50~−20 |
| 6. Blue 2 | (a) | −10~20 | (b) | −50~−20 |
| 7. Black | (a) | −5~5 | (b) | −5~5 |

Generally, the color range which can be expressed by the three primary colors and the black color is within the range of the dotted line in FIG. 2A and a part of green, orange and violet can not be fully expressed in some cases. Therefore, in the case where it is required to express these colors, it is preferred to use additionally at least one selected from orange (above VI), violet (above IX) and green (above X), particularly the dyes having the following a value and b value in addition to the dyes of the three primary colors and black color:

| | | |
|---|---|---|
| Orange | (a) 40~60 | (b) 50~80 |
| Violet | (a) 25~50 | (b) −45~−20 |
| Green | (a) −70~−40 | (b) 50~80 |

When these dyes are additionally used, the colors in the range of the solid line of FIG. 2B can be clearly obtained.

It is preferred to pretreat the cloth before dyeing to prevent bleeding of the dye liquid. Such a treatment is preferably made by calendering the cloth and/or by giving a water repellent finish to the cloth using a water repellent or a softening and water repellent thereby acheiving a water absorption of 5 to 240 seconds measured by JIS 1096A method or a water repellency of 50 or lower measured by JIS L-1018.

Such water repellents include, for example, fluorine compounds, silicone compounds and zirconium compounds. Such softening and water repellents include, for example, octadecylethyleneurea, zirconium acetate, polyolefine compounds, wax compounds, silicone compounds and the like. Fixing agents such as alkaline substances, e.g., sodium carbonate and sodium bicarbonate, and hydrotrope agents, e.g., urea, monomethylurea, dimethylurea, thiourea, monomethylthiourea, dimethylthiourea, formamide, dimethylformamide and dimehylacetamide may be also added to them.

Such a water repellent treatment may be carried out by using at least one compound selected from the above-mentioned water repellents and the softening and water repellents in combination with a sizing agent. Such sizing agent include, for example, water-soluble cellulose derivatives such as starch, soluble starch, water-soluble starch, water-soluble starch derivatives, carboxymethylcellulose, etherified carboxymethylcellulose, hydroxyethylcellulose and methylcellulose, gums such as sodium alginate, gum arabic, locust bean gum and guar gum, water-soluble proteins such as gelatin and glue, and water-soluble synthetic high polymers such as sodium polyacrylate, polyvinyl alcohol, polyethylene oxide, polyvinyl pyrrolidone, polyacrylamide, polyethyleneimine and quaternarized water-soluble cationic polymers. Furthermore, the bleeding of the dye liquid can be prevented by applying a breaking treatment in combination.

Particularly, it is preferred to use at least one compound selected from carboxymethylcellulose, etherified carboxymethylcellulose and sodium alginate and at least one compound selected from water-soluble acrylic resins and maleic acid resins in combination with the sizing agent mentioned above.

It is preferred that the water repellent and the softening and water repellent are applied so that they are only adhered to the outer surface of the cloth. In this case, it may be processed so that the water-absorbing agent is adhered on the back surface of the cloth where the water repellent and the softening and water repellent are not adhered.

The water-absorbing agent is not particularly restricted and, for example, a sizing agent and a water-absorbing silicone salt can be used.

Furthermore, as the method for pretreating the cloth, a method can be used in which a dye ink which can be adhered in dot during the printing is absorbed and maintained instantaneously on the surface of the cloth and a highly water-absorbent resin is adhered to prevent bleeding of the dye and color mixing. As the highly water-absorbent resins, any of the commercially available highly water-absorbent resins can be used. It is preferred to use a graft-polymerized or partly crosslinked product of water-soluble polymers such as of starch type, protein type, cellulose type or synthetic polymer type which have an ability of maintaining 10 to 1000 times amount of water based on its weight. The highly water-absorptive resin based on fibroin described in Japanese Patent Publication No. 57974 of 1983 can be used very effectively. The highly water-absorptive resin can be used together with other treating agents and particularly it is preferred to be used together with a softening and water-repellent.

As the dyes, reactive dyes, acid dyes, direct dyes, dispersion dyes, cationic dyes and fluorescent dyes may be used in accordance with the type of the fiber of the cloth to be dyed. It is preferred that the dye liquid is prepared to have a surface tension of 30 to 65 dyne/cm (particularly 40 to 50 dyne/cm) and a viscosity of 4 cps or less (particularly 1 to 2 cps) at 25° C.

It is preferable to use the following dyes as the three primary color dyes and black dye as they give sure dye fastness after dyed. The numbers show their CI numbers.

(1) Direct dyes

C.I. Direct Yellow 28, 39, 106

C.I. Direct Red 79, 80, 83, 92

C.I. Direct Blue 71, 78, 86, 106, 189, 199, 207, 218

C.I. Direct Black 62, 113

(2) Acid dyes

C.I. Acid Yellow 17, 19, 25, 38, 42, 49, 61, 72, 116, 127, 141, 161, 207

C.I. Acid Red 19, 28, 35, 37, 51, 57, 62, 95, 111, 114, 118, 131, 134 138, 145, 149, 158, 249, 254, 266, 274, 315, 366

C.I. Acid Blue 40, 49, 62, 78, 90, 92, 112, 113, 126, 127, 129, 133, 138, 140, 182, 299, 300

C.I. Acid Black 24, 26, 107, 109, 112, 155, 234

(3) Reactive dyes

C.I. Reactive Yellow 2, 81, 95, 116, 142, 161, Orange 12

C.I. Reactive Red 4, 24, 45, 108, 218

C.I. Reactive Blue 2, 5, 15, 19, 41, 49, 72, 75, 190

C.I. Reactive Black 1, 8

(4) Dispersion dyes

C.I. Dispersion Yellow 79, 160

C.I. Dispersion Red 50, 72, 127, 146, 154

C.I. Dispersion Blue 73, 142, 198, 224

C.I. Dispersion Black 1

Furthermore, in the present invention, it is preferred to use the dyes after removing inorganic salts, dispersing agents and solubilizers from them so that the dye liquid of very fine drops can be stably delivered in order to deposit the dye liquid on the cloth as a very small dots which can dye each single fibers in different colors. For example, it is preferable to use a water-soluble dye in which the contents of sodium, potassium, phosphorous and copper are respectively not higher than 0.01% and the contents of the anionic surface active agent and the nonionic surface active agent are respectively not higher than 0.015%. Particularly, when the contents of the mono- and divalent metal ions are controlled to be not higher than 10 ppm, it is preferred to use a water-soluble dye having a water solubility of not higher than 50 g/l at 20° C.

The following dyes can be exemplified as such water-soluble dyes. The numbers show their CI numbers.

① Direct dyes

C.I. Direct Yellow 28, 106

C.I. Direct Red 80, 83, 89

C.I. Direct Blue 80, 86, 106, 189, 199, 207

② Acid dyes

C.I. Acid Yellow 7, 38, 49, 72, 79, 141, 169, 219, 246

C.I. Acid Red 52, 114, 138, 249, 254, 260, 274, 361

C.I. Acid Blue 7, 9, 62, 90, 112, 113, 185, 225

C.I. Acid Black 26, 52, 109, 110

③ Reactive dyes

C.I. Reactive Yellow 13, 14, 75, 76, 77, 79, 115

C.I. Reactive Red 22, 23, 108, 109, 110, 111, 112, 113, 114

C.I. Reactive Blue 14, 19, 21, 27, 28, 100, 101, 148

C.I. Reactive Black 1, 5, 8

These water-soluble dyes are dissolved in water together with a dryness inhibitor to prepare a printing ink for ink jet. It is preferred to use glycols such as ethylene glycol, diethylene glycol, triethylene glycol, thiodiethylene glycol, diethylene glycol dimethyl ether, triethylene glycol dimethyl ether and polyethylene glycol dimethyl ether and urea and the like as the dryness inhibitors in amounts of 100 to 300 g/l.

When a reactive dye is used, it is preferable to be used as an aqueous ink containing an alkyl ether derivative of a polyhydric alcohol prepared by etherifying the primary and secondary alcohol groups in the polyhydric alcohol. In general, it is made to be a printing ink for ink jet consisting of 1 to 20 weight % of a reactive dye, 1 to 40 weight % of an alkyl ether derivative of a polyhydric alcohol mentioned above and 40 to 98 weight % of water. Known hydrotrope agents and surface active agents may be added to the printing ink.

The orange, violet, green and navy blue dyes additively used together with the three primary color dyes include the followings. The numbers show their CI numbers.

① Direct dyes

C.I. Direct Orange: 26, 29, 34, 39, 102, 118

C.I. Direct Violet: 9, 35, 47, 51, 66, 93, 95

C.I. Direct Green: 26, 59, 67

C.I. Direct Navy blue: blue 251, 248

② Acid dyes

C.I. Acid Orange: 7, 10, 56, 94, 142

C.I. Acid Violet: 19, 48, 49, 129

C.I. Acid Green: 5, 6, 12, 15, 19, 21

C.I. Acid Navy blue: blue 92, 120

③ Reactive dyes

C.I. Reactive Orange: 1, 4, 5, 7, 12, 14, 15, 16, 20, 29, 30

C.I. Reactive Violet: 1, 2, 4, 5, 6, 8, 9, 22, 34, 36

C.I. Reactive Green: 5, 6, 12, 15, 19, 21

C.I. Reactive Navy blue: blue 147, Black 39

④ Dispersion dyes

C.I. Dispersion Orange: 1, 3, 11, 13, 20, 25, 29, 30, 31, 32, 47, 55, 66

C.I. Dispersion Violet: 1, 4, 8, 23, 26, 28, 31, 33, 35, 38, 48, 56

C.I. Dispersion Green: 6, 9

C.I. Dispersion Navy blue: blue 146, 186

The printed cloth of the present invention is prepared by a procedure in which a cloth is optionally pretreated as mentioned above and then, or directly with no such pretreatment, a printing ink is sprayed on it to fix a desired printing pattern on it by an ink jet printing apparatus. Such printing apparatus include, for example, an apparatus including an ink jet recording head as described in Japanese patent Application No. 88545 of 1991. However, in order to make a fine dot printing desired by the present invention possible, it is preferred that a dye spraying apparatus, which has nozzles of not less than 80 dots/cm (200 dpi), particularly not less than 120 dots/cm (300 dpi), for three primary colors, is controlled based on the image signal to print a desired image with the use of the three primary color dyes.

The ink jet methods include, for example, a bubble jet method in which a heating resistor element is buried in a nozzle and an ink is boiled by its heat and the ink is delivered by the pressure of the bubbles, a pulse jet method in which an electric signal is applied on a piezoelectric element to deform it and the ink particles are blown by the excited volume change of the ink chamber, and an electric charge control method in which an ink is continuously pressure-sprayed from a nozzle vibrating by ultrasonic wave to particulate and the particles are controlled by the charge level and deviated by being passed through a definite electric field to be divided into recording particles and nonrecording particles.

Although the dyeing is limited to 24 colors in the usual screen printing, unlimited colors can be easily realized in the present invention only by using the three primary colors or the three primary colors and black color or by adding a small number of dyes such as orange, violet, green and navy blue to them. In addition, the dyeing can be carried out in dots for each single fiber unit of the yarn constituting the cloth. The dot length is as fine as 0.3 mm or less to the longitudinal direction of the filament and therefore a product of highly natural appearance and deep color can be prepared as if it is prepared by using yarns made by twisting fibers dyed in band each other (that is grandrelle yarn) to express a fine printed pattern. As the dye is clearly deposited on the front surface of the cloth with no penetration to the back surface, a deep color dyeing of high quality can be obtained.

Therefore, according to the present invention, as fine a line as 0.3 mm or less which could not be realized by a conventional method can be expressed stably in high quality as a printed pattern and an exact stripe pattern can be also given. Furthermore, a variety of colors can be reproduced elaborately to achieve the same printing results as the original picture and thus printed patterns of gradated tone and brush touch can be prepared in very high quality.

According to the present invention, a colored resist style product can be prepared by a procedure in which a dye ink containing a dye not decomposed by a reducing agent is applied on a cloth by ink jet method to form a printed pattern and then a reducing agent is applied on the printed pattern and the cloth is dyed with a reductively decolorizable dye.

Furthermore, a printed product of pepper-and-salt tone can be prepared by a procedure in which an original image of design is converted to a digital image data by an image input device and said image data is color separated by a color conversion device and then an ink jet device is controlled based on said separated image signals and random number signals to print the pattern on a cloth.

Although the method for the preparation of the original picture of repeated pattern in the printing according to the present invention is not particularly restricted, the preparation of an original picture can be made easily when a picture prepared by a procedure in which, when a pattern is drawn on the surface of a right-angled tetragon ABCD and the points internally dividing respectively a pair of the opposite sides AB and CD into a defined ratio m:n are defined to be E and F, said pattern is drawn so that it matches within an error of 0.3 mm or less on the segment BE and the segment DF or the segment AE and the segment CF, in both case that the segment BE and the segment DF are matched or that the segment AE and the segment CF are matched by rounding the tetragon into a cylinder so that the back surface of the tetragon ABCD comes inside is used as the original picture. In addition, a repeated pattern of high degree of perfection suitable for digital processing by a computer can be obtained.

In the present invention, the cloths include woven fabrics, knitted fabrics and nonwoven fabrics. The fibers constituting them may be natural fibers such as cotton, flax, wool and silk or synthetic fibers such as rayon, acetate, triacetate, Nylon, polyester and acrylic. They may be also their mixed fibers or union clothes.

When a cloth consisting of short fibers is used, friction marks tend to be formed by the contact of the ink jet nozzle with the fluff of the cloth. To prevent them and thus to obtain a fine image, it is preferred that the length of the fluff on the surface of the cloth is not more than 0.9 mm, the density of the fluff of 0.5 to 0.9 mm long is 15 fluffs/10 $cm^2$ or less and the density of the fluff of 0.5 mm long or shorter is 30 fluffs/10 $cm^2$ or less.

In order to satisfy such conditions, it is preferred to carry out a treatment with a fluff binding agent, an enzyme reduction treatment, double singeing treatment both on the raw cloth and on the scoured cloth, and shearing treatment after the preparations such as raw cloth singeing and scouring.

The fluff binding agents include, for example, water-soluble resins such as water-soluble polyester resin, polyvinyl alcohol, polyacrylic acid, casein, gelatin and thickner for printing, and emulsion resins such as hydrophilic polyester resin, vinyl compound polymers (polyvinyl acetate, polyvinyl acrylate resin and polyvinyl methyl resin).

For the above enzyme reduction, cellulose-decomposing enzymes such as cellulase and proteolytic enzymes such as protease can be used.

The singeing is carried out by a gas burner or by an electric heater. For example, the above-mentioned length of the fluff and the fluff density can be attained by a double singeing treatment both on the raw cloth and on the scoured cloth. A shearing may be carried out in place of the second singeing.

BRIEF DESCRIPTION OF THE DRAWINGS

FIG. 1 is an enlarged plan view showing the dyed condition in an example of a printed cloth according to the present invention.

FIGS. 2A and 2B are diagrams showing an example of the color range which can be expressed according to the present invention. FIG. 2A shows the case of using three primary color dyes and black dye, while FIG. 2B shows a case of using orange, violet, green and navy blue dyes in addition to the three primary color dyes and black dye.

BEST EMBODIMENTS FOR EXECUTING THE INVENTION

EXAMPLE 1

A cotton twill fabric, in which each of warp and weft was #50 single yarn, a warp density was 130 warps/inch and a weft density was 130 wefts/inch, was singed, desized, scoured and bleached by usual methods. The resultant cloth was padded by a treating solution consisting of the following composition and squeezed to a pick-up of 70% and then dried at 100° C. for 2 minutes.

| | |
|---|---|
| Yodosol PE-400 (polyolefin resin manufactured by Kanebo N.S.C. Co.) | 5 parts |
| Sodium carbonate | 2 parts |
| Water | 93 parts |

Then, the four color dye liquids as shown by the following ① to ④ were fed in an ink jet printer of bubble jet type and three patterns of A to C were printed on the pretreated fabric to 16 dots/mm and then dried at 120° C. for 2 minutes.

| Dye liquids | | |
|---|---|---|
| ① Yellow | CI Reactive Yellow 2 | 20 parts |
| | Urea | 5 parts |
| | Water | 75 parts |
| ② Red | CI Reactive Red 24 | 20 parts |
| | Urea | 5 parts |
| | Water | 75 parts |
| ③ Blue | CI Reactive Blue 49 | 20 parts |
| | Urea | 5 parts |
| | Water | 75 parts |
| ④ Black | CI Reactive Black 1 | 20 parts |
| | Urea | 5 parts |
| | Water | 75 parts |

Printed Pattern

A. A pattern in which colors including damask, lavender, violet, orchid, antique purple, skyblue, babyblue, celadon green and charcoal gray are expressed in hexagonal pattern and the boundaries between each colors are expressed by dark blue lines of 0.3 mm width.

B. A pattern expressing a rose of oil paint tone in which the petals are expressed a variety of colors in a gradated tone.

C. A stripe pattern in which fine uniform lines of 0.5 to 2 mm width consisting of two red colors, three yellow colors, five blue colors and two green colors are combined longitudinally and latitudinally.

Then the printed cloths were steamed at 108° C. for 20 minutes, washed and dried. In each of the products the desired printing pattern was clearly reproduced. For the pattern A, as a fine line as 0.3 mm was clearly dyed in different color with each other. The gradated pattern of B was clearly dyed in a more natural tone than general printing. Furthermore, the stripe pattern of C was dyed by different colors clearly in lines.

According to the microphotographs of the surface of these product, it was confirmed that the above four color dyes was deposited in dots to 0.07 to 0.2 mm long to the longitudinal direction of the fiber for each single fiber constituting the yarn. The deposited condition is shown in FIG. 1. It was also confirmed that the dye 3 dyes the warps 1 and 2 constituting the cloth in different colors as in grandrelle yarn.

EXAMPLE 2

A silk plain fabric in which each of warp and weft was #140 two ply yarn, the warp density was 122 warps/inch and the weft density was 105 wefts/inch, was scoured by a usual method. The resultant cloth was treated in the same manner as in Example 1 to obtain a product having a clear printed pattern of deep colors in very natural appearance as in Example 1. It was also confirmed that the dyed condition on the fiber constituting the fabric was the same as in the product of Example 1.

EXAMPLE 3

Method A

A spun Fuji silk fabric in which each of warp and weft was #140 two ply yarn, the warp density was 122 warps/inch and the weft density was 105 wefts/inch, was singed, desized, scoured and bleached. The resultant fabric was padded by an aqueous solution containing 0.3 part of a fluorine water repellent agent, Sumi Fluoil EM21 (manufactured by Sumitomo Kagaku Kogyo Co.) and 1 part of ammonium sulfate (pH controller) and then immediately squeezed by a mangle to a pick-up of 70% and dried at 120° C. for 3 minutes.

Then, 5 parts of each of the following six acid dyes was dissolved in 95 parts of water to prepare six dye liquids.

(1) CI Acid Violet 19

(2) CI Acid Orange 7

(3) CI Acid Red 131

(4) CI Acid Yellow 72

(5) CI Acid Blue 7

(6) CI Acid Black 110

With the use of these dye liquids, the above fabric was printed by an ink jet printer same as in Example 1 and dried at 120° C. for 2 minutes and then steamed by saturated steam at 102° C. for 30 minutes and washed.

Method B

The same method as Method A was carried out except that the following four dyes were used in place of the six dyes used in Method A.

(1) CI Acid Yellow 72

(2) CI Acid Red 6

(3) CI Acid Blue 7

(4) CI Acid Black 8

The printed pattern prepared by Method A could express a wide range of colors covering almost all range given by usual screen printing, while the printed pattern prepared by Method B was lower in concentration and narrower in the color range than those obtained by Method A.

EXAMPLE 4

Method A

A 100% cotton plain fabric, in which each of warp and weft was #50 single yarn, the warp density was 136 warps/inch and the weft density was 72 wefts/inch, was singed, desized, scoured, bleached and mercerized by usual methods. The resultant cloth was padded by a treating solution consisting of the following composition and squeezed to a pick-up of 70% and then dried at 120° C. for 2 minutes.

| | |
|---|---|
| Duck Algin NSPH (sodium alginate manufactured by Kibun Co.) | 0.1 part |
| Sodium carbonate (fixing reactant) | 3 parts |
| Urea (moisture retention agent) | 5 parts |
| Water | 91.9 parts |

Then, seven types of ink prepared by dissolving the following dyes in water respectively at a ratio of 2 to 8 were fed in an ink jet printer having seven ink jet heads and continuously printed on the fabric treated as above in 12 dots/mm to print each colors including scarlet, orange, violet and royal blue each in monochrome and compound color. Then, the fabric was dried at 120° C. for 2 minutes and steamed by saturated steam at 105° C. for 10 minutes and then washed.

(1) CI Reactive Yellow 95 (Yellow 1)

(2) CI Reactive Orange 12 (Yellow 2)

(3) CI Reactive Red 24 (Red 1)

(4) CI Reactive Red 218 (Red 2)

(5) CI Reactive Blue 15 (Blue 1)

(6) CI Reactive Blue 49 (Blue 2)

(7) CI Reactive Black 1 (Black)

Method B

The same method as Method A was carried out except that the inks of Yellow 2, Red 2 and Blue 2 were not used but the four inks of Yellow 1, Red 1, Blue 1 and Black were used.

Method C

The same method as Method A was carried out except that the inks of Yellow 1, Red 1 and Blue 1 were not used but the four inks of Yellow 2, Red 2, Blue 2 and Black were used.

The colors of the products prepared by Method A, Method B and Method C are shown in Table 1.

TABLE 1

| | Method A | | Method B | | Method C | |
|---|---|---|---|---|---|---|
| Color | a | b | a | b | a | b |
| Yellow 1 | −12.71 | 62.53 | −12.71 | 62.53 | — | — |
| Yellow 2 | 14.10 | 55.37 | — | — | 14.10 | 55.37 |
| Magenta 1 | 57.95 | 12.98 | 57.95 | 12.98 | — | — |
| Magenta 2 | 58.81 | −1.19 | | | 58.81 | −1.19 |
| Cyan 1 | −26.62 | −27.05 | −26.62 | −27.05 | — | — |
| Cyan 2 | 10.28 | −46.87 | — | — | 10.28 | −46.87 |
| Black | −2.31 | −3.79 | −2.31 | −3.79 | −2.31 | −3.79 |
| Scarlet | 51.01 | 29.82 | 50.48 | 22.30 | 42.43 | 20.03 |
| Orange | 25.43 | 53.42 | 24.98 | 43.20 | 21.21 | 42.34 |
| Violet | 31.00 | −20.02 | 9.84 | −7.52 | 30.98 | −20.05 |
| Royal blue | −12.52 | −30.05 | −15.43 | −12.10 | 10.43 | −33.20 |

As apparent from Table 1, Method A using the seven inks gave bright scarlet and orange and deep violet and royal blue, while Method B using only the four inks gave no deep colors though it gave bright colors. Method C gave deep colors but no bright colors.

EXAMPLE 5

Method A

A cotton plain fabric, in which each of warp and weft was #50 single yarn, the warp density was 72 warps/inch and the weft density was 72 wefts/inch, was singed, desized, scoured, bleached and mercerized by usual methods. The resultant cloth was padded by a treating solution consisting of the following composition and squeezed to a pick-up of 65% and then dried at 120° C. for 2 minutes.

| | |
|---|---|
| Sumifluoil EM-21 (fluorinated water repellent manufactured by Sumitomo Kagaku Kogyo Co., 30% solid) | 2 parts |
| Duck Algin NSPM (medium viscosity sodium alginate manufactured by Kibun Co.) | 0.5 part |
| Urea (hydrotropic agent) | 5 parts |
| Sodium bicarbonate (fixing reactant) | 3 parts |
| Water | 89.5 parts |

Then, a dye ink consisting of the following composition was fed in an ink jet printer and printed on the cloth thus pretreated in 8 dots/mm and dried at 120° C. for 2 minutes.

| | |
|---|---|
| CI Reactive Blue 2 | 10 parts |
| Urea | 8 parts |
| Water | 82 parts |

Then, a resist paste of the following composition was printed only on the portion of the fabric where the printed pattern has been formed by using a screen printer and dried at 120° C. for 2 minutes.

| | |
|---|---|
| Duck Algin NSPM (medium viscosity sodium alginate manufactured by Kibun Co.) | 2 parts |
| Resistol HWC (resist for reactive dyes manufactured by Meisei Kagaku Kogyo Co.) | 8 parts |
| Water | 90 parts |

Furthermore, a colored paste of the following composition was dyed on the fabric surface on which the resist paste was applied and dried at 120° C. for 2 minutes and then steamed by saturated steam at 102° C. 8 minutes, soaped and dried.

| | |
|---|---|
| CI Reactive Yellow 15 | 10 parts |
| Duck Algin NSPM (medium viscosity sodium alginate manufactured by Kibun Co.) | 2 parts |
| Urea (hydrotrope agent) | 5 parts |
| Sodium bicarbonate (fixing reactant) | 3 parts |
| Water | 80 parts |

Method B

The pretreating agent, the dye ink, the resist paste and the colored paste used in Method A were stored at room temperature for two weeks and then the same fabric as in Method A was dyed and resisted in the same manner as in Method A.

Method C

The following dye liquid was padded on the mercerized woven fabric used in Method A and dried at 120° C. for 2 minutes.

| | |
|---|---|
| CI Reactive Red 22 | 1.5 parts |
| CI Reactive Yellow 23 | 0.5 parts |
| Urea | 5 parts |
| Sodium bicarbonate | 3 parts |
| Acetic acid | 2 parts |
| Water | 88 parts |

Then, a dye ink of the following composition was fed in a ink jet printer and the cloth dyed by the above liquid was printed by the dye ink in 8 dots/mm and dried at 120° C. for 2 minutes and then steamed by saturated steam at 102° C. for 8 minutes, soaped and dried.

| | |
|---|---|
| CI Reactive Yellow 15 | 8 parts |
| GCR-13 (resist for reactive dyes manufactured by Senka Co.) | 8 parts |
| Urea | 5 parts |
| Water | 79 parts |

Method D

The dye liquid and the dye ink used in Method C were stored at room temperature for two weeks and then the cloth was dyed and resisted in the same manner as in Method C.

Bleeding of the printing ink, sharpness of pattern and ink stability of the products prepared by Methods A to D were evaluated macroscopically by 10 expert inspectors. The results are shown in Table 2.

| | |
|---|---|
| Bleeding of dye ink | ◎: No bleeding.<br>○: Some bleeding.<br>Δ: Slight bleeding.<br>X: High bleeding. |
| Sharpness of pattern | ○: Excellent in the sharpness of pattern.<br>Δ: Somewhat inferior in the sharpness of pattern.<br>X: Inferior in the sharpness of pattern. |
| Ink stability | ◎: Highly excellent in stability.<br>○: Excellent in stability.<br>Δ: Somewhat inferior in stability.<br>X: Inferior in stability. |

TABLE 2

| | Method A | Method B | Method C | Method D |
|---|---|---|---|---|
| Bleeding of dye ink | ◎ | ◎ | ○ | ○ |
| Sharpness of pattern | ○ | ○ | Δ | Δ~X |
| Ink stability | ◎ | ○ | ○ | X |

EXAMPLE 6

Method A

A 100% cotton plain fabric in which each of warp and weft was #40 single yarn, the warp density was 130 warps/inch and the weft density was 70 wefts/inch, was singed, desized, scoured, bleached and mercerized by usual methods. The resultant cloth was padded by a treating solution (A) of the following composition containing a highly water-absorptive resin and squeezed to a pick-up of 80% and then dried at 120° C. for 2 minutes.

| Treating solution (A) | |
|---|---|
| Silk Polymer M (4% aqueous solution of a highly water-absorptive resin, acrylic acid graft copolymer of silk fibroin, manufactured by Kanebo Co.) | 4 parts |
| Sodium carbonate ( fixing reactant ) | 2 parts |
| Water | 94 parts |

An ink of the following composition was fed in an ink jet printer of pulse jet type and a continuous print of 8 dots/mm was applied three times on the pretreated fabric.

| | |
|---|---|
| Reactive dye ( CI Reactive Red 31 ) | 15 parts |
| Urea | 5 parts |
| Water | 80 parts |

Then, the printed fabric thus prepared was steamed by saturated steam at 105° C. for 10 minutes and washed.

Method B

The same method as in Method A was carried out except that the following treating solution (B) was used in place of the treating solution (A).

| Treating solution (B) | |
|---|---|
| Lite Gel A (highly water-absorptive acrylic resin manufactured by Kyoeisha Yushi Kogyo Co., 40% active) | 10 parts |
| Sodium carbonate (fixing reactant) | 2 parts |
| Water | 88 parts |

Method C

The same method as in Method A was carried out except that no highly water-absorptive resin was added to the treating solution (A).

Method D

The same method as in Method A was carried out except that 2 parts of Duck Algin NSPH (medium viscosity sodium alginate manufactured by Kibun Foods Co.) was used in place of the highly water-absorptive resin in the treating solution (A).

Method E

The same method as in Method A was carried out except that 2 parts of Fine Gum HESK (modified carboxymethyl cellulose manufactured by Daiichi Kogyo Seiyaku Co.) was used in place of the highly water-absorptive resin in the treating solution (A).

The average dot diameter and the K/S value at the maximum absorption wave length of 540 nm of the printed pattern of the products prepared by Methods A to E. The results are shown in Table 3.

TABLE 3

| Method | Type of the resin of pretreating solution | Average dot diameter (μm) | K/S value front | K/S value back | Ratio of K/S front to back (%) |
|---|---|---|---|---|---|
| A | Highly water-absorptive resin | 15.3 | 15.124 | 0.434 | 2.9 |
| B | Highly water-absorptive resin | 14.9 | 14.998 | 0.513 | 3.4 |
| C | — | 31.3 | 7.214 | 2.692 | 36.8 |
| D | Printing resin | 24.8 | 9.219 | 1.734 | 18.8 |
| E | Printing resin | 25.2 | 8.994 | 1.883 | 20.9 |

As apparent from Table 3, Methods A and B gave sharp pattern, high surface concentration of the dye, low penetration and low bleeding though printed three times to give printed cloths of very high quality.

EXAMPLE 7

Method A

A 100% cotton plain fabric in which each of warp and weft was #50 single yarn, the warp density was 130 warps/inch and the weft density was 70 wefts/inch, was singed, desized, scoured, bleached and mercerized by usual methods. The resultant cloth was padded by a treating solution of the following composition containing a highly water-absorptive resin and squeezed to a pick-up of 60% and then dried at 120° C. for 2 minutes.

| | |
|---|---|
| Sodium carbonate | 2 parts |
| Urea | 5 parts |
| Water | 93 parts |

An ink of the following composition was fed in an ink jet printer of pulse jet type and a continuous printing was carried out in 8 dots/mm on the woven fabric thus pretreated.

| | |
|---|---|
| Reactive dye ( CI Reactive Red 24 ) | 8 parts |
| Diethylene glycol dimethyl ether | 10 parts |
| Urea | 5 parts |
| Water | 77 parts |

Then, the printed fabric thus prepared was steamed by saturated steam at 108° C. for 10 minutes, washed and dried.

Method B

The same method as in Method A was carried out except that triethylene glycol dimethyl ether was used in place of diethylene glycol dimethyl ether contained in the printing ink.

Method C

The same method as in Method A was carried out except that polyethylene glycol dimethyl ether was used in place of diethylene glycol dimethyl ether contained in the printing ink.

Method D

The same method as in Method A was carried out except that diethylene glycol was used in place of diethylene glycol dimethyl ether contained in the printing ink.

The K/S values of the products prepare by Methods A to D were measured at the maximum absorption wave length of 520 nm by using a Macbeth spectrophotometer M-2020. The periods required for the clogging of the nozzle when the fabric was ink jet printed by using the printing inks of Methods A to D were also measured. The results are shown in Table 4.

TABLE 4

| | Method A | Method B | Method C | Method D |
|---|---|---|---|---|
| Printing ink composition | | | | |
| Reactive dye | 8 | 8 | 8 | 8 |
| Diethylene glycol dimethyl ether | 10 | — | — | — |
| Triethylene glycol dimethyl ether | — | 10 | — | — |
| Polyethylene glycol dimethyl ether | — | — | 10 | — |
| Diethylene glycol | — | — | — | 10 |
| Urea | 3 | 3 | 3 | 3 |
| Water | 79 | 79 | 79 | 79 |
| K/S value | 7.35 | 7.01 | 6.89 | 5.15 |
| Nozzle clogging (hours) | <20 | <20 | <20 | <20 |

As apparent from Table 4, all of Methods A to D gave no nozzle clogging and showed good printing. Particularly, when a printing ink containing an alkyl ether derivative of a polyhydric alcohol (Methods A to C) was used, the ink delivery was good to give a product of high dye fixation.

EXAMPLE 8

Method A

A 100% cotton plain fabric in which each of warp and weft was #50 single yarn, the warp density was 72 warps/inch and the weft density was 72 wefts/inch, was singed, desized, scoured, bleached and mercerized by usual methods. The resultant cloth was padded by a treating solution of the following composition and squeezed to a pick-up of 65% and then one side of the cloth was dried by air flow at 120° C. for 3 minutes to migrate the treating solution to the dried surface.

| | |
|---|---|
| Sumifluoil EM-21 (fluorinated water repellent manufactured by Sumitomo Kagaku Kogyo Co., 30% solid) | 2 parts |
| Duck Algin NSPM (medium viscosity sodium alginate manufactured by Kibun Co.) | 0.3 part |
| Urea (hydrotrope agent) | 2 parts |
| Sodium bicarbonate (fixing reactant) | 2 parts |
| Water | 93.7 parts |

An ink of the following composition was fed in an ink jet printer of pulse jet type and a continuous printing was carried out in 8 dots/mm on the dried surface side of the cloth thus pretreated. Then, the cloth was dried at 120° C. for 2 minutes and steamed by saturated steam at 102° C. for 10 minutes and then washed and dried.

| | |
|---|---|
| Reactive dye ( CI Reactive Red 22 ) | 10 parts |
| Urea ( hydrotrope agent ) | 5 parts |
| Ethylene glycol | 5 parts |
| Water | 80 parts |

Method B

The same method as in Method A was carried out except that the pretreating solution was dried by a hot air flow at 120° C. for 2 minutes from the both sides of the plain woven fabric.

Method C

A polyester taffeta in which each of warp and weft was 50d/18f polyethylene teraphthalate, the warp density was 110 warps/inch and the weft density was 85 wefts/inch, was desized, scoured and heat set by usual methods. The following treating solution was padded to the resultant cloth and squeezed to a pick-up of 35% and then dried by hot air flow at 120° C. for 3 minutes from one side of the woven fabric to migrate the treating solution to the dried surface side.

| | |
|---|---|
| Sumifluoil EM-21 (fluorinated water repellent manufactured by Sumitomo Kagaku Kogyo Co., 30% solid) | 2 parts |
| Serparl SH-100 (natural gum manufactured by Adachi Koryo Co.) | 7 parts |
| Water | 91 parts |

An ink of the following composition was fed in an ink jet printer of pulse jet type and a continuous printing was carried out in 8 dots/mm on the dried surface side of the woven fabric thus pretreated.

| | |
|---|---|
| Disperse dye (CI Disperse Red 60) | 5 parts |
| Semol HT (dispersant manufactured by Nippon Senka Co.) | 8 parts |
| Ethylene glycol | 5 parts |
| Water | 82 parts |

Then, the cloth was dried at 120° C. for 2 minutes and steamed by HT steam at 180° C. for 8 minutes and then reductively washed in the following reduction bath, washed with water and dried.

| | |
|---|---|
| Soda ash | 0.2 part |
| Hydrosulfite | 0.2 part |
| Water | 99.6 parts |

Method D

The same method as in Method C was carried out except that the pretreating solution was dried by hot air flow at 120° C. for 2 minutes from the both sides of the cloth.

The bleeding and penetration of the printing ink in the printed cloth prepared by Methods A to D were measured by the following methods. The results are shown in Table 5.

(Bleeding)

It was evaluated by macroscopic observation by 10 expert inspectors. The criteria are as follows.

◎: No bleeding.

○: Some bleeding.

Δ: Slight bleeding.

X: High bleeding.

(Penetration)

◎: Very good penetration.

○: Good penetration.

Δ: Somewhat poor penetration.

X: Poor penetration.

TABLE 5

| | Method A | Method B | Method C | Method D |
|---|---|---|---|---|
| Bleeding | ◎ | ○ | ○ | Δ |
| Penetration | ○ | Δ | ○ | Δ |

As shown in Table 5, Methods A and C, in which a pretreating solution containing a water repellent was applied so that it was distributed only on the front surface side, gave very clear printed patterns of no bleeding and high penetration compared to Methods B and D in which the pretreating agent penetrated to the back surface side.

EXAMPLE 9

Method A

A plain 100% cotton fabric in which each of warp and weft was #50 single yarn, the warp density was 136 warps/inch and the weft density was 72 wefts/inch, was singed, desized, scoured, bleached and mercerized by usual methods. The following treating solution (1) was applied on one side of the resultant cloth by a knife overcoater and dried at 120° C. for 2 minutes and baked at 150° C. for 3 minutes. The amount of the water repellent adhered was 30 g/m$^2$.

| Treating solution (1) | |
|---|---|
| Asahi Guard AG480 (fluorinated water repellent manufactured by Asahi Glass Co., 30% solid) | 3 parts |
| Urea (hydrotrope agent) | 3 parts |
| Sodium bicarbonate (fixing reactant) | 3 parts |
| Water | 91 parts |

The following treating solution (2) was padded on the cloth thus pretreated and squeezed to a pick-up of 65% and then dried at 120° C. for 2 minutes.

| Treating solution (2) | |
|---|---|
| San Silicone-M (silicone water repellent manufactured by Sanyo Kasei Co., 30% solid) | 5 parts |
| Duck Algin NSPM (medium viscosity sodium alginate manufactured by Kibun Co.) | 2.5 parts |
| Water | 92.5 parts |

The two types of ink consisting of the following compositions were respectively fed in an ink jet printer of pulse jet type and a continuous printing in 8 dots/mm was carried out on the cloth pretreated in two steps and then dried at 120° C. for 2 minutes and steamed by saturated steam at 102° C. for 10 minutes, washed and dried.

| Ink (1) | |
|---|---|
| Reactive dye ( CI Reactive Blue 15 ) | 10 parts |
| Urea ( hydrotrope agent ) | 5 parts |
| Water | 85 parts |
| Ink (2) | |
| Reactive dye ( CI Reactive Red 22 ) | 10 parts |
| Urea ( hydrotrope agent ) | 5 parts |
| Water | 85 parts |

Method B

The same method as in Method A was carried out except that the treatment by the treating solution (1) [water repellent treating solution] was omitted.

Method C

The same method as in Method A was carried out except that the pretreatment was carried out by one step method in which the treating solution (1) [water repellent treating solution] was padded on the cloth and then the cloth was squeezed to a pick-up of 65% and dried at 120° C. for 2 minutes and baked at 150° C. for 3 minutes.

Bleeding, penetration and color development of the ink were tested on the products prepared by Methods A to C. The results are shown in Table 6.

Bleeding and penetration were evaluated by the same manner as in Table 5. Color development was evaluated by the following method.

(Color development)

⊙: Very good color development.

○: Good color development.

Δ: Somewhat poor color development.

X: Poor color development

TABLE 6

| | Method A | Method B | Method C |
|---|---|---|---|
| Bleeding | ⊙ | X | ⊙ |
| Penetration | ⊙ | ⊙ | X |
| Color development | ⊙ | X | Δ |

As shown in Table 6, Method A in which a water repellent was deposited only on the front surface of the cloth and a water absorber was deposited on the other portion showed no bleeding of the ink to give a printed cloth of sharp pattern, excellent color development and good quality.

EXAMPLE 10

Method A

A plain cotton fabric in which each of warp and weft was #50 single yarn, the warp density was 72 warps/inch and the weft density was 72 wefts/inch, was singed, desized, scoured, bleached and mercerized by usual methods. The following treating solution was padded on the resultant cloth and squeezed to a pick-up of 65% and dried at 120° C. for 2 minutes.

| | |
|---|---|
| Sumifluoil EM-21 (fluorinated water repellent manufactured by Sumitomo Kagaku Kogyo Co.) | 3 parts |
| Duck Algin NSPM (medium viscosity sodium alginate manufactured by Kibun Co.) | 0.5 parts |
| Urea ( hydrotrope agent ) | 5 parts |
| Sodium bicarbonate ( fixing reactant ) | 3 parts |
| Water | 88.5 parts |

The woven fabric thus pretreated was broken by a Sanforizer (made by Sanforize Co.) at a speed of 20 m/min. and then an ink of the following composition was fed in an ink jet printer of pulse jet type and a continuous printing was carried out in 8 dots/mm on said woven fabric and the fabric was dried at 120° C. for 2 minutes and steamed by saturated steam at 102° C. for 8 minutes, washed and dried.

| | |
|---|---|
| Reactive dye ( CI Reactive Blue 15 ) | 10 parts |
| Urea ( hydrotrope agent ) | 5 parts |
| Water | 85 parts |

Method B

The same method as in Method A was carried out except that a low temperature plasma treatment was carried out under an oxygen pressure of 0.5 Torr at a plasma output of 2 kw for 20 minutes in place of breaking treatment by Sanforizing.

Method C

The same method as in Method A was carried out except that no breaking treatment by Sanforizing was carried out.

Bleeding, penetration and color development of the ink were tested on the products prepared by Methods A to C by the same methods as in Example 9. The results are shown in Table 7.

TABLE 7

| | Method A | Method B | Method C |
|---|---|---|---|
| Bleeding | ⊙~○ | ⊙ | ⊙ |
| Penetration | ○ | ○~⊙ | Δ |
| Color development | ⊙ | ⊙ | ○~Δ |

As shown in Table 7, Methods A and B in which a breaking treatment was carried out after a water repellent treatment gave printed cloths of very good quality.

EXAMPLE 11

Method A

A plain 100% cotton fabric, in which each of warp and weft was #50 single yarn, the warp density was 136 warps/inch and the weft density was 72 wefts/inch, was singed, desized, scoured, bleached and mercerized by usual methods. The following treating solution was padded on the resultant cloth and squeezed to a pick-up of 80% and dried at 120° C. for 2 minutes.

| | |
|---|---|
| Fine Gum HES (carboxymethyl cellulose manufactured by Daiichi Kogyo Seiyaku Co.) | 0.5 parts |
| FD Thickener 100 (water-soluble acrylic resin manufactured by Furukawa Kagaku Kogyo Co., 28% solid) | 3 parts |
| Scotch Guard FC-214 (fluorinated water repellent manufactured by Sumitomo 3M Co., 15% solid) | 0.05 parts |
| Sodium carbonate ( fixing reactant ) | 3 parts |
| Urea ( hydrotrope agent ) | 5 parts |
| Water | 88.45 parts |

An ink of the following composition was fed in an ink jet printer of pulse jet type and a continuous printing was carried out in 8 dots/mm on the cloth thus pretreated and then the cloth was dried at 120° C. for 2 minutes and steamed by saturated steam at 102° C. for 10 minutes, washed and dried.

| | |
|---|---|
| CI Reactive Red 49 | 15 parts |
| Urea ( hydrotrope agent ) | 5 parts |
| Water | 80 parts |

Method B

The same method as in Method A was carried out except that Sanko Matec N-30 (maleic acid resin manufactured by Sanko Shoji Co., 30% solid) was used in place of FD Thickener in the pretreating agent.

Method C

The same method as in Method A was carried out except that Scotch Guard FC-214 was not used in the pretreating agent.

Method D

The same method as in Method A was carried out except that FD Thickener 100 was not used in the pretreating agent.

Method E

The same method as in Method A was carried out except that Fine Gum HES was not used in the pretreating agent.

Method F

The same method as in Method A was carried out except that Viclon 90 (cationic softening agent manufactured by Ipposha Yushi Kogyo Co., 35% solid) was used in place of Scotch Guard FC-214 in the pretreating agent.

Method G

The same method as in Method A was carried out except that Evafanol N-20 (urethane resin manufactured by NICCA Co., 20% solid) was used in place of FD Thickener in the pretreating agent.

Method H

The same method as in Method A was carried out except that Sorbitol C-5 (etherified starch manufactured by Avebe Co.) was used in place of Fine Gum HES in the pretreating agent.

Bleeding and print quality of the products prepared by Methods A to H were evaluated by three ranks method (○, Δ, X). The results are shown in Table 8.

TABLE 8

| Method | A | B | C | D | E | F | G | H |
|---|---|---|---|---|---|---|---|---|
| Bleeding | ○ | ○ | Δ | Δ | Δ | X~Δ | X~Δ | X~Δ |
| Print quality | ○ | ○ | Δ | Δ | Δ | Δ | Δ | Δ |

As shown in Table 8, Methods A and B in which the cloth was pretreated with a treating solution containing carboxymethyl cellulose, a water-soluble acrylic resin (or a maleic acid resin) and a water repellent gave printed cloth of very high quality compared to other methods.

EXAMPLE 12

Method A

A plain 100% cotton fabric, in which each of warp and weft was #50 single yarn, the warp density was 136 warps/inch and the weft density was 72 wefts/inch, was singed, desized, scoured, bleached and mercerized by usual methods. The following treating solution was padded on the resultant cloth and squeezed to a pick-up of 70% and dried at 120° C. for 2 minutes.

| | |
|---|---|
| TK Set 102 (water-soluble polyester high molecular copolymer, fluff binder) | 5 parts |
| Sodium bicarbonate (dye fixing agent) | 3 parts |
| Urea (hydrotrope agent) | 5 parts |
| Water | 87 parts |

An ink of the following composition was fed in an ink jet printer of pulse jet type and a continuous printing was carried out in 8 dots/mm on the woven fabric thus pretreated and then dried at 120° C. for 2 minutes and steamed by saturated steam at 105° C. for 10 minutes, washed and dried. The space between the cloth and the nozzle of the ink jet printer was 0.9 mm.

| | |
|---|---|
| CI Reactive Blue 49 | 15 parts |
| Urea ( hydrotrope agent ) | 5 parts |
| Water | 80 parts |

Method B

The same method as in Method A was carried out except that the pretreating solution in Method A was coated by a kiss roll applicator to 30 g/m$^2$ on wet basis and dried at 120° C. for 2 minutes.

Method C

The same method as in Method A was carried out except that no fluff binder (TK Set 102) was added to the pretreating solution.

Method D

The same method as in Method B was carried out except that no fluff binder (TK Set 102) was added to the pretreating solution.

Method E

The same method as in Method B was carried out except that no fluff binder (TK Set 102) was added to the pretreating solution and the space between the cloth and the nozzle of the ink jet printer was made to be 1.5 mm.

Fluff length, fluff density, continuous printability, dot diameter of the product and defect number per 10 mm (white dot, friction mark, dirt, etc.) in Methods A to E are shown in Table 9.

The surface fluff was measured by the following method.

A cloth platform X consisting of a stainless steel sheet of 20 cm long, 20 cm wide and 10 mm thick having a projection of 10 mm long, 100 mm wide and 5 mm thick in the c enter of its surface and a weight sheet Y of 15 cm long, 15 cm wide and 5 mm thick having a hole of 11 mm long and 101 mm wide were prepared. A test cloth was placed on said cloth platform X and the weight sheet Y was fit on it so that said hole got said projection to fix the test cloth on said projection. A single laser beam irradiation apparatus was set at the position of the fluff length to be measured and the laser beam was irradiated on the fluffs and the beam was moved horizontally. The laser beam scattered at the end of the fluffs was observed macroscopically to count the number of the fluffs. The measurement was made on five different sites of the cloth and their average was used as the value.

TABLE 9

| Method | | A | B | C | D | E |
|---|---|---|---|---|---|---|
| Addition of fluff binder | | Yes | No | Yes | No | No |
| Space between cloth & nozzle(mm) | | 0.9 | 0.9 | 0.9 | 0.9 | 1.5 |
| Fluff length | Average | 0.6 | 2.1 | 0.4 | 1.8 | 1.8 |
| ( mm ) | Maximum | 0.8 | 3.7 | 0.6 | 2.4 | 2.4 |
| Fluff density | 0.9 mm or higher | 0 | 24 | 0 | 12 | 12 |
| ( fluffs/ | 0.5~0.9 mm | 14 | 41 | 18 | 32 | 32 |
| 10 $cm^2$ ) | Lower than 0.5 mm | 24 | 83 | 11 | 79 | 88 |
| Continuous printability ( hour ) | | >20 | 0.9 | >20 | 3.4 | 4.7 |
| Dot diameter | Warp | 10.2 | 10.3 | 9.8 | 9.9 | 16.7 |
| ( $\mu$m ) | Weft | 9.1 | 9.2 | 8.8 | 8.7 | 15.2 |
| | Average | 9.7 | 9.8 | 9.3 | 9.3 | 15.8 |
| Defect number per 10 m ( number ) | | 0 | 21 | 0 | 15 | 6 |

As shown in Table 9, Methods A and B using cloths in which the fluff length on the surface was 0.9 mm or less and the fluff density of the fluffs of 0.5 to 0.9 mm long and fluff density of the fluffs of a length of less than 0.5 mm were respectively 15 fluffs/10 $cm^2$ or lower and 30 fluffs/10 $cm^2$ or lower gave printed cloths of fine image and high quality with no friction mark nor dirt.

EXAMPLE 13

Method A

A plain 100% silk woven fabric, in which each of warp and weft was #50 single yarn, the warp density was 110 warps/inch and the weft density was 76 wefts/inch, was scoured and bleached by usual methods. The following treating solution was padded on the resultant cloth and squeezed to a pick-up of 70% and dried at 120° C. for 3 minutes.

| | |
|---|---|
| Sumifluoil EM-21 (manufactured by Sumitomo Kagaku Kogyo Co.) | 0.3 parts |
| Ammonium sulfate | 1 part |
| Water | 98.7 parts |

An ink consisting of 30 parts of a dye solution purified as follows, 20 parts of diethylene glycol and 50 parts of water was fed in n ink jet printer of pulse jet type and a continuous printing in 8 dos/mm was carried out on the cloth thus pretreated and the cloth was dried at 120° C. for 2 minutes and steamed by saturated steam at 102° C. for 10 minutes, washed and dried.

The above-mentioned dye solution was prepared by purifying an acid dye (CI Acid Red 289) in two steps as follows.

(1) Removal of Surface Active Agent

ES771 (amine exchanging group type phenolic resin manufactured by Sumitomo Kagaku Kogyo Co.) was washed with water and converted to —OH type with sodium hydroxide and further washed with water. 450 g of the resultant adsorbing resin was added to a 15% aqueous solution of said dye and the mixture was stood for 8 hours and then filtered to remove the resin and dried to purify the dye. The purification was repeated 5 times to decrease the contents of the anionic and nonionic surface active agents respectively to 0.015% or lower on dye powder basis.

(2) Removal of Sodium and Other Components

A 15% aqueous solution of the dye purified above was prepared and the dye was further purified by using an RO Minitester (made by Teijin Engineering Co., membrane: B-21 type, M.W.:1000). The purification was repeated 5 times to decrease the contents of calcium, potassium, phosphorous and copper respectively to 0.01% or lower on dye powder basis.

Method B

The same method as in Method A was carried out except that the dye was purified by only the method (1) of removing the surface active agents. In this case, the dye contained 4.0% sodium, 0.02% calcium, 0.02% potassium, 0.2% phosphorous and 0.2% copper.

Method C

The same method as in Method A was carried out except that the dye was purified by only the method (2) of removing sodium and others. In this case, the dye contained 0.03% of the anionic surface active agent and 0.03% of the nonionic surface active agent.

Method D

The same method as in Method A was carried out except that the dye was not purified at all.

The numbers of nondelivery of ink of the products prepared by Methods A to D were measure macroscopically. The results are shown in Table 10.

TABLE 10

| | Method A | Method B | Method C | Method D |
|---|---|---|---|---|
| Nondelivery number ( line/m ) | 0.012 | 2.33 | 1.96 | 3.05 |

As apparent from Table 10, Method A using the dye purified in two steps of (1) and (2) gave small nondelivery number of ink and the product was excellent in jet stability to prepare a printed product of high quality.

Commercial Utility

According to the present invention, dot dyeing units are formed in very small line along the fiber to a thickness of monofilament (ca. 0.01 to 0.1 mm) and to a longitudinal length of 0.3 mm or shorter. Therefore, a printed cloth of very natural appearance in which the yarns constituting the cloth are dyed in different colors as if each of them consists of different grandrelle yarn. As fine a line as 0.3 mm which could not be obtained up to now can be dyed clearly in different colors and a product of exact stripe pattern or having gradation pattern of complex combination of a variety of colors can be prepared. In addition, according to the present invention, the dye does not penetrate to the back surface of the cloth and deposits on the front surface of the cloth clearly and thus a deep dyeing can be achieved.

What is claimed is:

1. A method for the preparation of a printed cloth by an ink-jet printing method in which dyes comprising the three primary colors, the color black, and at least one selected from the colors orange, violet and green are separately deposited on a cloth with an ink-jet printing device having a nozzle resolution of 120 dots/cm or more and controlled by an image signal, said cloth having substantially no fluff with a length of more than 0.9 mm on the surface.

2. A method according to claim 1 wherein said orange, violet and green colors have a perceived chromaticity index (a) and (b) defined in color range CIE 1976 (L, a, b) space on the cloth within the following range: Orange: (a) 40~60 (b) 50~80; Violet: (a) 25~50 (b) −45~−20; Green: (a) −70~−40 (b) 50~80.

3. A method according to claim 2 further comprising the steps of treating a cloth with at least one water repellent agent selected from the group consisting of fluorine compounds, silicone compounds, zirconium compounds, octadecylethylene-urea, polyolefin compounds and wax compounds, and then separately depositing said dyes on the cloth with an ink-jet printing device.

4. A method according to claim 2 further comprising the steps of treating a cloth with at least one water repellent agent selected from the group consisting of fluorine compounds, silicone compounds, zirconium compounds, octadecylethylene-urea, polyolefin compounds and wax compounds, and at least one sizing agent selected from the group consisting of starches, water-soluble starch derivatives, water-soluble cellulose derivatives, sodium alginate, gum arabic, locust bean gum, guar gum, water-soluble proteins and water-soluble synthetic polymers, and then separately depositing said dyes on the cloth with an ink-jet printing device.

5. A method according to claim 3 wherein the step of treating the cloth comprises treating the cloth with said water repellent agent together with (1) at least one compound selected from the group consisting of carboxymethyl cellulose, etherified carboxymethyl cellulose and sodium alginate and (2) at least one resin selected from the group consisting of water-soluble acrylic resins and maleic acid resins.

6. A method according to claim 2 further comprising the steps of treating a cloth with a highly water-absorbing resin having an ability of maintaining 10 to 1000 times amount of water based on its weight, and then separately depositing said dyes on the cloth with an ink-jet printing device.

* * * * *